US005789364A

United States Patent [19]

Sells et al.

[11] Patent Number: 5,789,364

[45] Date of Patent: Aug. 4, 1998

[54] HIGH WATER LIQUID ENZYME PREWASH COMPOSITION

[75] Inventors: Todd Douglas Sells, Alamo; David Lawrence DeLeeuw, San Ramon, both of Calif.; Michael Koerner, Tucson, Ariz.

[73] Assignee: The Clorox Company, Oakland, Calif.

[21] Appl. No.: 664,040

[22] Filed: Jun. 13, 1996

Related U.S. Application Data

[63] Continuation-in-part of Ser. No. 474,353, Jun. 7, 1995, Pat. No. 5,589,448, which is a continuation of Ser. No. 18,621, Feb. 17, 1993, abandoned.

[51] Int. Cl.[6] ..... C11D 17/04; C11D 7/42; C11D 17/00; C11D 3/386

[52] U.S. Cl. ..... 510/284; 510/393; 510/417; 510/418; 510/465; 510/530

[58] Field of Search ..... 510/284, 393, 510/417, 418, 465, 530

[56] References Cited

U.S. PATENT DOCUMENTS

| | | | |
|---|---|---|---|
| 3,741,902 | 6/1973 | Barrett, Jr. et al. | 252/90 |
| 3,746,649 | 7/1973 | Barrett, Jr. et al. | 252/170 |
| 3,761,420 | 9/1973 | Bogardus | 252/171 |
| 3,784,476 | 1/1974 | van Kampen et al. | 252/109 |
| 3,812,041 | 5/1974 | Inamorato | 252/89 |
| 3,819,528 | 6/1974 | Berry | 252/153 |
| 3,860,536 | 1/1975 | Landwerlen et al. | 252/551 |
| 3,869,399 | 3/1975 | Collins | 252/118 |
| 3,870,647 | 3/1975 | Travers | 252/118 |
| 3,953,351 | 4/1976 | Keller | 252/132 |
| 4,021,377 | 5/1977 | Borchert et al. | 252/546 |
| 4,079,078 | 3/1978 | Collins | 252/545 |
| 4,105,431 | 8/1978 | Lewis et al. | 71/67 |
| 4,169,817 | 10/1979 | Weber | 252/545 |
| 4,178,262 | 12/1979 | Compton et al. | 252/162 |
| 4,199,482 | 4/1980 | Renaud et al. | 252/559 |
| 4,201,686 | 5/1980 | Augustijn | 252/174.22 |
| 4,243,546 | 1/1981 | Shaer | 252/174.12 |
| 4,252,694 | 2/1981 | Lewis et al. | 252/545 |
| 4,268,262 | 5/1981 | Bechstedt | 8/137 |
| 4,285,841 | 8/1981 | Barrat et al. | 252/559 |
| 4,287,082 | 9/1981 | Tolfo et al. | 252/174.12 |
| 4,295,845 | 10/1981 | Sepulveda et al. | 8/139.1 |
| 4,305,837 | 12/1981 | Kaminsky et al. | 252/174.12 |
| 4,318,818 | 3/1982 | Letton et al. | 252/174.12 |
| 4,338,212 | 7/1982 | Wegener et al. | 252/174.22 |
| 4,362,638 | 12/1982 | Caskey et al. | 252/90 |
| 4,404,115 | 9/1983 | Tai | 252/135 |
| 4,438,009 | 3/1984 | Brusky et al. | 252/90 |
| 4,457,857 | 7/1984 | Sepulveda et al. | 252/174.21 |
| 4,515,705 | 5/1985 | Moeddel | 252/174.12 |
| 4,530,780 | 7/1985 | van de Pas, et al. | 252/528 |
| 4,537,707 | 8/1985 | Severson, Jr. | 252/545 |
| 4,595,527 | 6/1986 | Gipp | 252/546 |
| 4,608,189 | 8/1986 | Koch et al. | 252/174.22 |
| 4,648,987 | 3/1987 | Smith et al. | 252/559 |
| 4,711,739 | 12/1987 | Kandathil | 252/139 |
| 4,738,791 | 4/1988 | Ertle | 252/118 |
| 4,738,792 | 4/1988 | Ertle | 252/118 |
| 4,749,516 | 6/1988 | Brusky | 252/546 |
| 4,767,562 | 8/1988 | Fry | 252/174.12 |
| 4,793,943 | 12/1988 | Haslop et al. | 252/135 |
| 4,801,544 | 1/1989 | Munk | 435/188 |
| 4,822,511 | 4/1989 | Law | 252/106 |
| 4,834,900 | 5/1989 | Soldanski et al. | 252/88 |
| 4,861,516 | 8/1989 | Kurzendorfer et al. | 252/531 |
| 4,900,475 | 2/1990 | Ramachandran et al. | 252/532 |
| 4,909,962 | 3/1990 | Clark | 252/547 |
| 4,911,857 | 3/1990 | Machin et al. | 252/98 |
| 4,954,286 | 9/1990 | Sepulveda et al. | 252/174.22 |
| 4,959,179 | 9/1990 | Aronson et al. | 252/135 |
| 5,021,195 | 6/1991 | Machin et al. | 252/545 |
| 5,035,826 | 7/1991 | Durbut et al. | 252/121 |
| 5,071,586 | 12/1991 | Kaiserman | 252/174.12 |
| 5,186,856 | 2/1993 | Holland | 252/143 |
| 5,205,957 | 4/1993 | Van DePas | 252/173 |
| 5,269,960 | 12/1993 | Gray et al. | 252/174.12 |
| 5,612,306 | 3/1997 | O'Brien | 510/321 |

FOREIGN PATENT DOCUMENTS

| | | |
|---|---|---|
| 0414549 | 2/1991 | European Pat. Off. . |
| 9105845 | 5/1991 | WIPO . |

*Primary Examiner*—Mukund J. Shah
*Assistant Examiner*—Brenda Coleman
*Attorney, Agent, or Firm*—Sharon R. Kantor

[57] ABSTRACT

The invention provides a high water liquid enzyme prewash composition essentially free of hydrotropes, solvents, dispersants and surfactants, other than nonionic surfactants, combining: a hydrolase enzyme stabilized with a first enzyme stabilizer, wherein the first enzyme stabilizer is a soluble alkaline earth salt; a more hydrophilic, first nonionic surfactant having an HLB of greater than about 11; a more hydrophobic, second nonionic surfactant having an HLB of less than or equal to about 11; and at least about 80–99% water; wherein the difference in HLB between the first and the second nonionic surfactants is at least 2; the nonionic surfactants interact with the water to form an opalescent, structured liquid; the first and the second nonionic surfactants are selected from the group consisting of alkoxylated alcohols and alkoxylated alkylphenols; the structured liquid both suspends the hydrolase and protects the hydrolase against deactivation with water. The inventive high water liquid enzyme prewash compositions may also contain a second hydrolase enzyme and a second enzyme stabilizer. Suitable adjuncts, such as mildewstats, bacteriostats, fragrances and dyes may also be included.

19 Claims, No Drawings

HIGH WATER LIQUID ENZYME PREWASH COMPOSITION

This is a Continuation-in-Part of Ser. No. 08/474,353 issued as U.S. Pat. No. 5,589,448 on 31 Dec. 1996, which is a Continuation of Ser. No. 08/018,621, filed Feb. 17, 1993, now abandoned.

BACKGROUND OF THE INVENTION

1. Field of the Invention

The invention relates to a high water liquid enzyme-containing prewash composition essentially free of hydrotropes, solvents, dispersants and surfactants, other than nonionic surfactants, in which two or more enzymes are stably suspended in a structured liquid matrix and are further protected against deactivation by free water. More particularly, the invention relates to a high water liquid prewash composition in which two or more different classes of enzymes are stably suspended in an opalescent, structured liquid which contains a soluble alkaline earth salt as a first enzyme stabilizer, and a second enzyme stabilizer.

2. Brief Statement of the Related Art

Many liquid detergent and prewash (or prespotter) compositions have been formulated to meet the need for pretreatment of particularly problematic fabric stains, whether oily, particulate or enzyme-sensitive. Each of these products suffers from various drawbacks. Gelled or semi-solid prewash sticks require direct, mechanical application to the fabric and may not be desirable for all purposes. Solvent-based liquid products are convenient to use but, typically, are limited in purpose since many are formulated primarily to attack oily stains. For example, Barrett, Jr., U.S. Pat. No. 3,741,902, discloses a laundry prespotter in which large amounts of organic solvent and a nonionic surfactant are combined to produce a nonaqueous composition. However, high amounts of organic solvents in products are disfavored because of current regulatory schemes. Bogardus, U.S. Pat. No. 3,761,420, discloses a stabilized enzyme stain remover in which enzymes are protected from deactivation in an aqueous matrix by large amounts of glycerol, a solvent. To similar effect are: Barrett, Jr., U.S. Pat. No. 3,746,649 (variety of solvents); Weber, U.S. Pat. No. 4,169,817 (propylene glycol); Landwerlen, et al., U.S. Pat. No. 3,860,536 (propylene glycol); Fry, U.S. Pat. No. 4,767,562 (propylene glycol); and Kandathil, U.S. Pat. No. 4,711,739 (insoluble polyether polyol and hydrocarbon solvent).

A major problem that has been encountered with enzyme-containing systems has been adequate retention of enzyme activity over long periods of time. Some liquid detergent compositions have addressed enzyme stability by using solvents to reduce water activity, or other components to reversibly inhibit enzymes. For example, Panandiker, et al., U.S. Pat. No. 5,472,628, disclose a detergent composition that includes an aryl boronic acid complex to inhibit proteolytic enzymes. When placed in a typical wash situation, the aryl boron compound is released, thus restoring enzyme activity. Panandiker, et al., U.S. Pat. No. 5,468,414, disclose a mixture of vicinal polyols and boric acid in addition to an alphahydroxy acid builder. Tai, U.S. Pat. No. 4,404,115, discloses the use of sulphonates, triphosphates and methylcellulose in addition to an alkali metal pentaborate.

However, none of the foregoing references teaches, discloses or suggests a high water liquid enzyme prewash composition essentially free of organic solvents, hydrotropes and dispersants other than nonionic surfactants in which two or more enzymes are stably suspended in a structured liquid matrix caused by interaction of the nonionic surfactants in the highly aqueous medium and in which the enzymes are protected against deactivation by water by the structured liquid matrix.

SUMMARY OF THE INVENTION AND OBJECTS

The invention provides a stable enzyme system for use in a high water opalescent structured liquid prewash composition that is essentially free of hydrotropes, solvents and surfactants other than nonionic surfactants, where there is a difference in hydrophile-lipophile balance (HLB) between a first and a second nonionic surfactant of at least two, and the nonionic surfactants interact with water to both suspend the enzymes of the enzyme system and protect the enzymes against deactivation with water. The stable enzyme system comprises:

a) an effective amount of a first hydrolase enzyme stabilized with a first enzyme stabilizer, wherein the first enzyme stabilizer is a soluble alkaline earth salt;

b) an effective amount of a second hydrolase enzyme; and c) an effective amount of a second enzyme stabilizer.

More particularly, the invention provides novel stable enzyme systems for use in a high water liquid prewash composition essentially free of hydrotropes, solvents and surfactants other than nonionic surfactants, comprising:

a) an effective amount of a first hydrolase enzyme stabilized with a first enzyme stabilizer, wherein the first enzyme stabilizer is a soluble alkaline earth salt;

b) an effective amount of a second hydrolase enzyme;

c) an effective amount of a second enzyme stabilizer;

d) a more hydrophilic, first nonionic surfactant having an HLB of greater than about 11;

e) a more hydrophobic, second nonionic surfactant having an HLB of less than or equal to about 11; and f) at least 80% or greater water;

wherein the first and second hydrolase enzymes comprise different classes of enzymes, the difference in HLB between the first and second nonionic surfactants is at least about two, and the nonionic surfactants interact with water to form an opalescent, structured liquid, wherein the structured liquid both suspends the first and second enzymes and protects the first and second enzymes against deactivation with water, and further wherein the first and second nonionic surfactants are selected from the group consisting of alkoxylated alcohols and alkoxylated alkyl phenols.

It is therefore an object of this invention to provide a stable enzyme system suitable for use in high water prewash compositions without the use of solvents, hydrotropes or surfactants other than nonionic surfactants.

It is another object of the invention to provide a high water stable liquid enzyme prewash composition including a sufficient amount of two enzyme stabilizers which act to both maintain and stabilize the enzymes suspended in the structured liquid of the inventive prewash compositions.

It is yet another object of this invention to provide a stable high water liquid enzyme prewash composition with a stable enzyme system which prevents loss of enzyme activity of a first class of enzyme in the presence of a second class of enzyme.

It is still another object of this invention to provide a stable high water liquid enzyme prewash composition in which a first nonionic surfactant forms a first, continuous phase with the water in the composition and a second nonionic surfactant forms a dispersed, lamellar phase in the first phase, the difference in HLB between the first and second nonionic surfactants is at least about two, the nonionic surfactants interact with water to form an opalescent, structured liquid which both suspends a first and a second enzyme and may protect the enzymes against deactivation from water, and the first and second nonionic surfactants are selected from the group consisting of alkoxylated alcohols and alkoxylated alkyl phenols.

DETAILED DESCRIPTION OF THE INVENTION

The invention provides a stable enzyme system for use in a high water opalescent structured liquid prewash composition that is essentially free of hydrotropes, solvents and surfactants other than nonionic surfactants, where there is a difference in HLB between a first and second nonionic surfactant of at least two, and the nonionic surfactants interact with water to both suspend the enzyme system and protect the enzymes against deactivation with water. The improved enzyme system comprises:

a) an effective amount of a first hydrolase enzyme stabilized with a first enzyme stabilizer, wherein the first enzyme stabilizer is a soluble alkaline earth salt;

b) an effective amount of a second hydrolase enzyme; and c) an effective amount of a second enzyme stabilizer.

According to a first embodiment of the invention, a novel stable enzyme system may be formulated in a high water liquid enzyme prewash composition essentially free of hydrotropes, solvents and dispersants other than nonionic surfactants, comprising:

a) an effective amount of a first hydrolase enzyme stabilized with a first enzyme stabilizer, wherein the first enzyme stabilizer is a soluble alkaline earth salt;

b) an effective amount of a second hydrolase enzyme;

c) an effective amount of a second enzyme stabilizer;

d) a more hydrophilic, first nonionic surfactant having an HLB of greater than about 11;

e) a more hydrophobic, second nonionic surfactant having an HLB of less than or equal to about 11; and f) at least 80% or greater water;

wherein the first and second enzymes comprise different classes of enzymes, the difference in HLB between the first and second nonionic surfactants is at least about two, and the nonionic surfactants interact with water to form an opalescent, structured liquid, wherein the structured liquid both suspends the first and second enzymes and protects the first and second enzymes against deactivation with water, and further wherein the first and second nonionic surfactants are selected from the group consisting of alkoxylated alcohols and alkoxylated alkyl phenols. Optionally, small amounts of additional adjuncts such as fragrances, dyes, mildewstats, bacteriostats and the like can also be included to provide desirable attributes of such adjuncts.

In the application, effective amounts are generally those amounts listed as the ranges or levels of ingredients in the descriptions which follow hereto. It is understood that any amounts expressed in percent or percentage ("%") are in terms of weight percent (wt %) of the composition, unless otherwise noted.

1. Nonionic Surfactants

As stated beforehand, the nonionic surfactants used in the enzyme systems of the present invention are essentially the only dispersing agents present in the invention, with any solvents such as propylene glycol or ethanol being present in trace amounts as manufacturing by-products of ingredients such as the surfactants or stabilizers for the enzymes. In fact, it has been found that large amounts of solvents, hydrotropes, and even inorganic salts or other dispersants, can destabilize the structured liquid matrix of the invention and, for that reason, are generally avoided.

The nonionic surfactants are: a more hydrophilic, first nonionic surfactant having an HLB of greater than about 11 and a more hydrophobic, second nonionic surfactant having an HLB of less than about 11, with the further proviso that there is a difference, delta ($\Delta$), of about at least two, and most preferably, at least about 3, in the HLB values of the two surfactants.

The nonionic surfactants are selected from alkoxylated alcohols and alkoxylated alkylphenols. The alkoxylated alkylphenols are especially preferred. The alkoxylated alkylphenols include ethoxylated, propoxylated, and ethoxylated and propoxylated $C_{5-20}$ alkyl phenols, with about 1–20 moles of ethylene oxide, or about 1–20 moles propylene oxide, or about 1–20 and 1–20 moles of ethylene oxide and propylene oxide, respectively, per mole of hydrophobe, with the selection of the first and second alkoxylated alkylphenols being determined according to HLB values. These surfactants appear to form a specific structured liquid in water. Here, the definition of a "structured liquid" is one where, unlike the interaction between surfactants and electrolytes in a liquid detergent containing builders or salts, the structure is due to separate interactions of the two surfactants with water as well as with each other. The structured liquid thus formed contains the surfactants in a decreased aqueous environment, which may also be characterized as an "oil-in-water" emulsion. Most preferred among the surfactant pairs is a combination of two ethoxylated nonylphenols.

1.a. First Nonionic Surfactant

The first nonionic surfactant can be chosen from among the following: Macol NP-9.5, an ethoxylated nonylphenol with about 11 moles ethylene oxide ("EO") and a hydrophile-lipophile balance ("HLB") of 14.2, and Macol NP-9.5, an ethoxylated nonylphenol with about 9.5 moles EO and an HLB of 13.0, both from Mazer Chemicals, Inc.; Triton N-101, an ethoxylated nonylphenol with 9–10 moles of EO per mole of alcohol and an HLB of 13.4 and Triton N-111, an ethoxylated nonylphenol with an HLB of 13.8, both from Rohm & Haas Co.; Igepal CO-730, with an HLB of 15.0, Igepal CO-720, with an HLB of 14.2, Igepal CO-710, with an HLB of 13.6, Igepal CO-660, with an HLB of 13.2, Igepal CO-620, with an HLB of 12.6, and Igepal CO-610 with an HLB of 12.2, all of which are polyethoxylated nonylphenols available from Rhone-Poulenc; the Alkasurf family of surfactants, such as Alkasurf NP-15, with an HLB of 15, Alkasurf NP-12, with an HLB of 13.9, Alkasurf NP-11, with an HLB of 13.8, Alkasurf NP- 10 with an HLB of 13.5, Alkasurf NP-9, with an HLB of 13.4, and Alkasurf NP-8, with an HLB of 12.0; all polyethoxylated nonylphenols from Rhone-Poulenc; and the Surfonic® line of surfactants such as Surfonic N-120, with an HLB of 14.1, Surfonic N-102, with an HLB of 13.5, Surfonic N-100, with an HLB of 13.3, Surfonic N-95, with an HLB of 12.9, and Surfonic N-85, with an HLB of 12.4, all of which are polyethoxylated nonylphenols from Huntsman Chemical Co.

1.b. Second Nonionic Surfactant

The second nonionic surfactant can be selected from: Macol NP-6, an ethoxylated nonylphenol with 6 moles of EO and an HLB of 10.8, Macol NP-4, an ethoxylated nonylphenol with 4 moles of EO and an HLB of 8.8, both of which are from Mazer Chemicals, Inc.; Triton N-57, an ethoxylated nonylphenol with an HLB of 10.0, Triton N-42, an ethoxylated nonylphenol with an HLB of 9.1, both from Union Carbide; Igepal CO-530, with an HLB of 10.8, and Igepal CO-520, with an HLB of 10.0, both ethoxylated nonylphenols from Rhone-Poulenc; Alkasurf NP-6, with an HLB of 11.0, Alkasurf NP-5, with an HLB of 10.0, and Alkasurf NP-4, with an HLB of 9.0, all ethoxylated nonylphenols from Rhone-Poulenc; Surfonic N-60, with an HLB of 10.9, and Surfonic N-40, with an HLB of 8.9, both ethoxylated nonylphenols from Huntsman Chemical Co. See also *McCutcheon's Emulsifiers and Detergents* (1994), especially pages 292–295, incorporated herein by reference thereto. The amounts of the first and second surfactants are preferably in the range of about 0.1% to 9.99% and about 0.1% to 9.99%, respectively, and most preferably, about 3% to 6% and about 5% to 9%, respectively. The ratios of the first and second surfactants will be about 5:1 to 1:5, more preferably about 4:1 to 1:4, and most preferably about 3:1 to about 1:3.

The interaction between the surfactants is not believed to be a charged-based interaction, but may be due to unique structures occurring in the liquid phase. See, e.g., P. Ekwall, "Composition, Properties and Structures of Liquid Crystal and Phases in Systems of Amphiphilic Compounds"; and C. Miller et al., "Behavior of Dilute Lamellar Liquid-Crystal and Phases." *Colloids and Surfaces*, Vol. 19, pp. 197–223 (1986); and W. J. Benton, et al., "Lyotropic Liquid Crystalline Phases and Dispersions in Dilute Anionic Surfactant-Alcohol-Brine Systems," *J. Physical Chemistry*, Vol. 87, pp. 4981–4991 (1983), which are incorporated herein by reference.

It is again speculated, without being thereby bound, that the first, more hydrophilic nonionic surfactant is readily dispersed in water in the invention, thereby forming a first, continuous liquid phase, while the second, more hydrophobic nonionic surfactant forms a discontinuous, lamellar phase in the first, continuous phase. Light scattering studies appear to bear this out and the resulting liquid composition is an opalescent liquid (a complex, translucent liquid, which scatters visible light). Opalescence is a characteristic of more highly ordered forms of emulsions such as liquid crystals, which may be thermodynamically very stable. The fact that liquid crystals form suggests that the enzymes are retained within a less hydrophilic environment, which may further explain the unusual stability of the enzymes in the inventive novel surfactant matrices.

The alkoxylated alcohols include ethoxylated, propoxylated, and ethoxylated and propoxylated $C_{5-20}$ alcohols, with about 1–20 moles of ethylene oxide, or about 1–20 moles of propylene oxide, or 1–20 and 1–20 moles of ethylene oxide and propylene oxide, respectively, per mole of alcohol, with the selection of the first and second alkoxylated alcohol being determined according to HLB values, again. There are a wide variety of products from numerous manufacturers, such as the Neodol series from Shell Chemical Co. See also *McCutcheon's Emulsifiers and Detergents* (1994), especially pates 292–294.

2. Enzyme System

In order to improve cleaning performance, it is desirable to incorporate two or more enzymes, in particular two or more different types or classes of enzymes, into a single prewash formulation. One difficulty in achieving this goal is the fact that it has been problematic to include additional enzymes, particularly in those high water aqueous systems, in which a protein-hydrolyzing enzyme was already present. The present invention therefore comprises a stable enzyme system capable of providing two or more different enzymes for use in high water liquid enzyme prewash compositions, in which at least one of the enzymes is a protein-hydrolyzing enzyme. The enzyme systems are particularly useful for simultaneously removing two or more different types of enzyme-sensitive stains and soils in applications in which a prewash article is commonly desirable. According to the present invention, the enzymes which are used comprise a first protein-hydrolyzing enzyme and a second non-protein hydrolyzing enzyme in combination with an effective amount of a second enzyme stabilizer. The second enzyme stabilizer, which is used to reduce the activity of the first hydrolyzing enzyme towards the second as well as towards any other non-hydrolyzing enzymes in the aqueous matrix of the invention, is discussed in greater detail below.

2.a. Protein-Hydrolyzing Enzyme

The first critical component of the stable enzyme systems described herein is a first hydrolase enzyme comprising at least one protein-hydrolyzing enzyme or protease, which is especially desirable herein. Proteases, or proteinases used herein act by hydrolyzing a given proteinaceous substrate, such as protein-containing stains, and converting the substrate to a more soluble or easily removed form.

One especially preferred class of hydrolytic enzyme are proteases. Proteases may be selected from among acidic, neutral and alkaline proteases. The terms "acidic," "neutral," and "alkaline," refer to the pH at which enzymes' activity are optimal. Examples of neutral proteases which may be used in the stable enzyme systems of the present invention include Milezyme® (available from Miles Laboratory) and trypsin, the latter a naturally occurring protease. The preferred hydrolase enzyme used herein is an alkaline protease. Alkaline proteases are available from a wide variety of commercial sources, and are characteristically produced from various microorganisms (e.g., *Bacillis subtilisin*). Typical examples of alkaline proteases include: Maxatase® and Maxacal®, from International BioSynthetics; and Alcalase®, Savinase® and Esperase®, from Novo Nordisk A/S. See also Stanislowski, et al., U.S. Pat. No. 4,511,490, incorporated herein by reference.

The first hydrolase enzyme should be present in an amount of about 0.0001–10%, more preferably about 0.001–5%, and most preferably about 0.01–2% by weight of the prewash composition based on an enzyme that is 100% active. Most commercially available enzymes are sold as liquids, slurries, prills or solids, however, in which either a liquid or solid filler/stabilizer is included, such that the enzyme is less than 100% active. One example of a commonly encountered stabilizer/filler is propylene glycol. The activity of the enzyme must therefore be considered when preparing any of the formulations consistent with the present invention.

2.b. Non-Protein Hydrolyzing Enzyme

In addition to a first, protein-hydrolyzing enzyme, a second critical component of the high liquid stabilized enzyme systems for prewash formulations according to the present invention comprises a second hydrolase enzyme, which further comprises at least one non-protein-hydrolyzing enzyme. The non-protein-hydrolyzing enzyme may be selected from the group comprising amylases, cellulases, lipases, cutinases, etc.

Amylases, which are carbohydrate-hydrolyzing enzymes, comprise one class of enzyme that is particularly appropriate for use in the present invention. Suitable amylases include: Rapidase®, from Société Rapidase; Termamyl® from Novo Nordisk A/S; Milezyme® from Miles Laboratory; and Maxamyl® from International BioSynthesis. Termamyl® is particularly preferred. Cellulases, which are cellulose-hydrolyzing enzymes, may also be used as the second enzyme in the inventive enzyme systems. Examples of cellulases include Tai, U.S. Pat. No. 4,479,881; Murata, et al, U.S. Pat. No. 4,443,355; Barbesgaard, et al., U.S. Pat. No. 4,435,307; and Ohya, et al., U.S. Pat. No. 3,983,082, incorporated herein by reference. Yet another potentially suitable enzyme source are the lipases, which are glyceride-hydrolyzing enzymes. A number of lipases have been described in Silver, U.S. Pat. No. 3,950,277; and Thom, et al., U.S. Pat. No. 4,707,291, and are incorporated herein by reference.

The second hydrolase enzyme should be present in an amount that is therefore about 0.0001–10 wt. %, more preferably about 0.0005–5%, and most preferably about 0.001–2% by weight of the formulation based on a second hydrolase enzyme that is 100% active. As with protein-hydrolyzable enzymes described above, most commercially available non-protein enzymes are also sold in a combined form such that the enzyme activity is less than 100%. A typical stabilizer and/or filler for non-protein hydrolase enzymes is again propylene glycol. The activity of the second enzyme as commercially formulated must therefore be taken into account when preparing any of the formulations consistent with the present invention.

Enzyme stability in highly aqueous systems has been very problematic. This problem was summed up by Kandathil, U.S. Pat. No. 4,711,739, thusly:

> Water is known to have a deteriorating effect on the catalytic activity of hydrolytic enzymes. During storage in water in the absence of a substrate capable of being hydrolyzed, the enzymes tend to digest themselves.

(Kandathil, col. 4, lines 25–29.) Kandathil's solution to this recognized problem was to use relatively large amounts of both an insoluble polyether polyol and hydrocarbon solvents to stabilize the enzyme. A secondary effect of having so many diverse ingredients in Kandathil's system was to drive down the total amount of water, resulting in a complex, expensive system.

By contrast, the invention presents a straightforward improved enzyme liquid prewash composition in which a first enzyme stabilizer and a second enzyme stabilizer are present. The first enzyme stabilizer, namely a soluble alkaline earth salt, interacts with the structured liquid phase of the invention (a more detailed description of which follows herein) in order to both stably suspend the novel enzyme system and protect the enzymes against degradation from the high level of water present in the invention.

3. First Enzyme Stabilizer

The first enzyme stabilizer used in accordance with the present invention may be selected from the group consisting essentially of alkaline earth salts, which include calcium, magnesium and barium salts. Representative examples of the alkaline earth salts include formates, acetates, propionates, hydroxides and chlorides. Calcium chloride is especially preferred. The amount of soluble alkaline earth salt should be preferably from about 1 part per million ("ppm") to about 10,000 ppm, more preferably about 10 ppm to about 1,000 ppm, and most preferably about 10 ppm to about 500 ppm.

Applicants speculate, without being thereby bound that, unlike the prior art—in which an alkaline earth salt, such as soluble calcium, was available as free calcium ions (see, Letton, U.S. Pat No. 4,318,818, column 6, lines 9–12)—the soluble alkaline earth salts of the present invention bind to one or more enzymes of the stable enzyme systems so as to reduce the hydrophilicity of the enzymes, thus causing the enzymes to partition more readily to the oily phase represented by the less soluble of the nonionic surfactants used in the invention. It is this partitioning phenomenon which is believed to be partly responsible for the unexpected excellent stability of the enzymes in the highly aqueous systems of the invention, since, unlike the prior art, large quantities of solvents and other enzyme stabilizers are not needed herein. Moreover, the structured liquid phase of the invention does not apparently encapsulate the enzymes, but rather closely associates with the entire enzyme system, thus allowing the enzymes to perform well not only when a protein-based fabric soil is contacted with the liquid prewash, but also thereafter when the liquid prewash is diluted in the wash liquor.

4. Second Enzyme Stabilizer

Excellent performance and shelf-life characteristics, even at elevated temperatures, may be achieved when a second enzyme stabilizer is included with the inventive enzyme systems described herein. In contrast to the alkaline earth salts described immediately above, the second enzyme stabilizer may perform a different function within the inventive prewash compositions. The first enzyme stabilizer appears to stably suspend the enzymes by causing them to preferably partition to the oily or hydrophobic phase characterized by the less soluble of the nonionic surfactants. By contrast, Applicants speculate, without being bound by theory, that the second enzyme stabilizer engages in some form of non-suspending role with one or more enzymes of the enzyme system. The second enzyme stabilizer may be selected from the group consisting essentially of boron compounds, antioxidants, short-chain organic or inorganic acids, and mixtures thereof.

One possible function of the second enzyme stabilizer may be to prevent any interaction whereby a first enzyme could attack, destabilize, denature or degrade a second enzyme present in the inventive formulations. In this instance, the second enzyme stabilizer may be characterized as binding with or otherwise taking up active sites on a first enzyme so as to impair its reactivity towards a second enzyme. Applicants theorize, without being bound thereby, that the nature of this relationship may be characterized by one or more of the following intrinsic characteristics: binding, adsorption or absorption; hydrogen bonding; electrostatic interactions such as ion/ion or ion/dipole interactions; intercalation, incorporation or insertion into one or more enzymes; chemical or physical bonding, etc.; or any suitable combination thereof. Boron compounds as used herein, refers to any boron-containing compounds which are capable of inhibiting proteolytic enzyme activity. Boron compounds, which may be regarded as exemplars of one class of second enzyme stabilizers, thus include boric acid, boric oxide and alkali metal borates. Preferably, the boron compound is boric acid. It is conceivable that other short chain inorganic or organic acids which are shown to improve enzyme stability may also be used as a second enzyme stabilizer, an example of which is formic acid.

Another possible function for the second enzyme stabilizer according to the present invention may be to scavenge any deleterious entity from the enzyme environment that could otherwise destabilize, denature or degrade the enzyme and thus result in impaired performance of the enzyme system. For instance, the second enzyme stabilizer may extrinsically function as a reducing agent to scavenge oxidants such as peroxide and hypochlorite from the inventive enzyme systems. Mild reducing agents can have a noticeable impact on the enzyme stability of the prewash formulations, even where starting levels of oxidants were determined to be extremely low (less than 1 ppm). Applicants therefore speculate, without being bound thereby, that the second enzyme stabilizer may not only remove oxidants from the prewash formulations, but they may also provide a secondary benefit such as impeding the ability of a first enzyme to attack a second. It is to be understood that any reference to reducing agents or antioxidants contained herein refers specifically to mildly reactive reducing agents or mild antioxidants. Thus, in addition to the boron compounds described above, mild antioxidants or reducing agents are therefore another class of second enzyme stabilizer which may be used to provide certain benefit to the enzyme system according to the present invention. Mild antioxidants may be selected from the group consisting essentially of alkali metal salts of mild reducing agents such as—although not necessarily limited to—alkali metal salts of thiosulfates; sulfites and bisulfites; and mixtures thereof. Alkali metal thiosulfates are preferred antioxidants, and sodium is the preferred alkali metal.

Perhaps somewhat surprisingly, it has now been found that an antioxidant may be used either in addition to—or in lieu of—a boron compound with the stable enzyme systems of the present invention. When thiosulfate was included in several inventive prewash formulations that also comprised a protease and an amylase, for example, unexpectedly high activity levels of both the protease and amylase were observed over time, even in the absence of any boron-containing compounds. Also somewhat unexpectedly, it has been found that surprisingly small amounts of the second enzyme stabilizer can have a dramatic impact on the stability and performance of the inventive prewash solutions. An effective amount of the second enzyme stabilizer that has been found to be suitable for use in the enzyme systems of the present invention may fall within the range of about 1–10,000 ppm, that is, at least approximately 0.001 wt. %, more preferably at least about 0.005 wt %, and most preferably at least about 0.01 wt. % of the total weight of the stabilized enzyme-containing prewash formulation. There is no real upper limit on the amount of second enzyme stabilizer which can be added to achieve the desirable results obtained herein. For practical purposes and cost savings, however, it is desirable to use less than about 2.0 wt. % of the second enzyme stabilizer, preferably less than about 1.8 wt. %, and most preferably less than about 1.5 wt. %.

5. Water

The principal ingredient of the inventive stable enzyme prewash formulations is water, which should be present at a level of at least about 80%, more preferably at least about 82%, and most preferably, at least about 85%. Deionized water is most preferred. It is again noted that water can deactivate enzymes because, with the exception of lipases, enzymes are generally somewhat hydrophilic in nature. Consequently, water can mediate cross-digestion—especially in the case of proteases—leading to significant loss of enzyme activity. However, the unique and surprising oil-in-water aqueous liquid micelle structure of the invention, together with the first and second enzyme stabilizers described above, are responsible for the advantageous suspension, protection and stability of the enzymes within the aqueous medium.

In certain instances, it should be noted that there may be finite—albeit low-levels of certain impurities that are naturally found in various water sources. Hypochlorite, for instance, is frequently an intentional water supplement that is introduced into water supplies by various municipalities. In one instance, for example, loss of enzyme activity was attributed to hypochlorite contained in one municipally delivered water source, even when the hypochlorite was present in amounts barely exceeding levels of approximately 1.0 ppm. While a mild reducing agent such as sodium thiosulfate can be added to the inventive enzyme systems in very low levels to prevent loss of enzyme activity, the presence of residual hypochlorite introduced from a water supply can negatively impact the small amounts of thiosulfate used. It is therefore recommended that in those formulations where it is desirable to add thiosulfate or thiosulfite, water systems be monitored for oxidants that could affect enzyme stability.

6. Effect of pH

One example of a high water liquid prewash composition that is essentially free of hydrotropes, solvents, dispersants and surfactants, other than nonionic surfactants and which contains a hydrolase enzyme stabilized with a soluble alkaline earth salt was recently described and recited in copending and jointly owned application for patent, U.S. Ser. No. 08/474,353, which is incorporated by reference herein. In the course of this earlier work, it was found that optimal stabilities for enzyme-containing high water prewash formulations could be realized when the pH of the compositions were somewhat acidic to neutral, namely from above about pH 4 to just below about pH 8, most preferably about pH 5 to 7. As the literature is replete with techniques for stabilizing alkaline proteases at alkaline pH's where their cleaning performance is optimal, it was surprising to find that enzymes could be safely stored at low pH's—without eventual loss of activity in an alkaline wash environment—as described in the '353 application.

Quite unexpectedly, it has now been discovered that when a second, non-protein-hydrolyzing enzyme is used in combination with a first, protein-hydrolyzing enzyme in a prewash composition that was otherwise stable at acidic pH ranges, the resulting enzyme system is less stable at the same formerly low pH values. Optimal stability of the enzyme systems described herein is achieved not only through the use of a second enzyme stabilizer as discussed above, but primarily through variation of the pH, as will now be described in greater detail.

According to the teaching of the present invention, it is desirable to provide a hydrogen ion concentration (pH) in the inventive prewash formulations such that the enzyme systems are maintained in the most stable environment possible. Quite surprisingly, it has been found that a neutral to slightly basic pH is most suitable for achieving this goal. While there are many prewash formulations described in the prior art that operate at a slightly basic pH, this fact was quite unexpected for the formulations of the present invention.

When a first protein-hydrolyzing enzyme was included in prewash formulations similar to those of the current invention, but which did not contain a second enzyme stabilizer, the pH of the resulting compositions could vary from about 4 to about 7. When the pH of a series of similarly-prepared solutions was adjusted to vary from about 4.0 to 9.0, the highest percent enzyme activity was observed at about pH 4.8 to about 7.6, even after four weeks at temperatures as high as 32.2° C. (90° F.; see, for example, FIG. 3 of the '353 application). When a second, non-protein hydrolyzing enzyme was added to a similar high water formulation, again without the addition of a second enzyme stabilizer, the pH of the resulting mixtures remained mildly acidic. Unexpectedly, however, it was discovered that these latter mixtures were no longer stable at mildly acidic pH's. The resulting protein-hydrolyzing and non-protein hydrolyzing enzyme mixtures exhibited very poor retention of enzyme activity when stored at elevated temperatures without any pH adjustment. These results were quite unexpected, since the addition of the second enzyme stabilizer was not expected to have any influence on the pH or the stability of the as-formulated compositions.

Quite surprisingly, the pH ranges which have been found to be optimal for the present invention are somewhat neutral to slightly basic, and range from about 6.8 to about 8.2, preferably from about 7.0 to about 8.0, and most preferably from about 7.2 to about 8.0. Maintaining the proper pH is therefore important for realizing the full potential benefits of the stable enzyme prewash formulations of the present invention. Only by adjusting the pH of the mixed enzyme prewash compositions, especially at elevated temperatures, is it possible to maintain enzyme activity and safely store the enzyme formulations for long periods of time.

In order to provide the desired pH values for the inventive prewash formulations discussed herein, various bases and buffers which are known and described in the literature may be used either alone or in combination. The base may be either an inorganic or an organic base. Alkali metal and alkali earth hydroxides are typical bases which may be used for this purpose, and sodium hydroxide is preferred. The amount of base that is required to adjust to a basic pH is rather low, typically from about 0.0001 to about 1.0 wt. %.

8. Miscellaneous Adjuncts

Small amounts of miscellaneous adjuncts such as fragrances, dyes and pigments, can be added to improve aesthetic qualities of the prewash invention. Aesthetic adjuncts which may be used in accordance with the teaching of the present invention include fragrances, such as those available from Givaudan, IFF, Quest and others. If in oil form, the fragrances may require a dispersant, although quantities thereof should be quite limited, in fact on the order of trace amounts (i.e., 0–2 wt. %, preferably 0–1 wt. %). Dyes and pigments which can be solubilized or suspended in the formulation may also be used in trace amounts, generally up to about 0.1 percent by weight.

As the surfactants in the liquid systems of the present invention are sometimes subject to attack by microorganisms and/or bacteria, it may be advantageous to add a preservative such as a mildewstat or bacteriostat. It has surprisingly been discovered that mildewstats or bacteriostats which are not formaldehyde-exuding are preferred herein. Without being bound by theory, Applicants speculate that formaldehyde acts to deactivate the enzymes in the prewash formulation. Exemplary non-formaldehyde-exuding mildewstats (including non-isothiazolone compounds) include: Kathon GC, a 5-chloro-2-methyl-4-isothiazolin-3-one, Kathon ICP, a 2-methyl-4isothiazolin-3-one, as well as a blend of the foregoing, in addition to Kathon 886, a 5-chloro-2-methyl-4-isothiazolin-3-one, all available from Rohm and Haas Company; Bronopol, a 2-bromo-2-nitro-propane 1,3-diol, from Boots Company Ltd.; Proxel CRL, a propyl-p-hydroxybenzoate, from ICI PLC; Nipasol M, an o-phenyl-phenol, $Na^+$ salt, from Nipa Laboratories Ltd.; Dowicide A, a 1,2-benzoisothiazolin-3-one, from Dow Chemical Co.; and Irgasan DP 200, a 2,4,4'-trichloro-2-hydroxydiphenylether, from Ciba-Geigy A. G. See also, Lewis, et al., U.S. Pat. No. 4,252,694 and U.S. Pat. No. 4,105,431, incorporated herein by reference.

The following examples serve to further illustrate some of the surprising performance benefits of the various aspects of the inventive prewash formulations.

EXPERIMENTAL

A typical preferred formulation for the inventive high water stable enzyme prewash compositions is set forth in Table I. Note that the weight percentages given for the components below are for the particular enzyme solutions as received from the indicated manufacturer. In the absence of any pH adjustment, typical pH values for prewash formulations prepared according to Table I vary from approximately 4 to 7.

TABLE I

| Prewash Ingredient | Description | Quantity (wt. %) |
|---|---|---|
| First surfactant[1] | Nonionic surfactant, HLB > 11 | 3–6 |
| Second surfactant[2] | Nonionic surfactant, HLB ≦ 11 | 5–9 |
| First hydrolase enzyme solution[3] | Protein-hydrolyzing enzyme | 0.01–0.5 |
| Second hydrolase enzyme solution[4] | Non-protein hydrolyzing enzyme | 0.01–0.5 |
| First enzyme stabilizer[5] | | 0.01–0.05 |
| Second enzyme stabilizer | | 0.01–1.0 |
| Optional adjuncts and/or auxiliaries | Preservative, fragrance, dye | 0.0–1.0 |
| Water | Solvent | Balance |

[1]Alkoxylated alcohol or alkoxylated alkylphenol.
[2]Alkoxylated alcohol or alkoxylated alkylphenol.
[3]Alkaline protease used as received.
[4]Amylase used as received.
[5]$Ca^{++}$ ion.

EXAMPLE 1

In one embodiment of the present invention, a series of prewash formulations were prepared according to Table I that contained: a nonyl phenyl ethoxylate (9–10 moles ethoxylate) as the first surfactant; a nonyl phenol ethoxylate (5 mole ethoxylate) as the second surfactant; a protease enzyme as the first hydrolase enzyme; an amylase enzyme as the second hydrolase enzyme; calcium chloride as the first enzyme stabilizer; and boric acid as the second enzyme stabilizer. The auxiliaries comprised a preservative, fragrance, and trace amounts of dye. The formulations were tested for long term storage stability of amylase and protease at elevated temperatures over time, to simulate advanced aging of the samples. The results are shown in Tables II and III, respectively, below.

TABLE II

Stability of Amylase in Example I Formulations at 37.8° C. (100° F.) for Different pH Levels

| | Percent Amylase Activity Remaining After: | | |
|---|---|---|---|
| pH | 2 weeks (wt. %) | 4 weeks (wt. %) | 12 weeks (wt. %) |
| 5.0 | 22 | 0 | n.a.[1] |
| 6.4 | 80 | 80 | 20 |
| 6.8 | 90 | 56 | 33 |
| 7.2 | 90 | 90 | 67 |
| 7.6 | 90 | 100 | 90 |
| 8.0 | 100 | 89 | 78 |

[1]Data not analyzed.

TABLE III

Stability of Protease in Example I Formulations at 37.8° C. (100° F.) for Different pH Levels

| pH | Percent Protease Activity Remaining After: 2 weeks (wt. %) | 4 weeks (wt. %) | 12 weeks (wt. %) |
|---|---|---|---|
| 5.0 | 56 | 24 | n.a.[1] |
| 6.4 | 94 | 50 | 16 |
| 6.8 | 83 | 86 | 41 |
| 7.2 | 87 | 53 | 57 |
| 7.6 | 86 | 82 | 36 |
| 8.0 | 74 | 67 | 23 |

[1]Data not analyzed

Performance of the inventive formulations as set forth in Table I were compared at different pH's as shown in Tables II and III. From the data presented, it may be seen that amylase exhibited greater stability than did the protease measured in terms of percent enzyme activity remaining at elevated temperatures. These results are not entirely unexpected, as amylase is known to be more thermally stable. What was surprising, however, was that the mere addition of a second hydrolase enzyme to an otherwise stable prewash formulation that already contained one hydrolase enzyme would result in decreased stability for the enzyme system overall. A prior high water prewash formulation containing a protease that surprisingly exhibited optimal long-term thermal stability at a pH range of approximately 5–7 has already been described and discussed elsewhere (the '353 application, above). It had been anticipated that the addition of a second hydrolase enzyme to a mixed HLB-surfactant system similar to those described in the '353 application would result in the achievement of a relatively stable enzyme system. It was totally unexpected, therefore, that the instant inventive prewash formulations exhibited poor stability for either amylase or protease within the previously preferred pH range. As contrasted to optimal enzyme activity which was observed at lower pH ranges in the '353 application, it was surprising to discover that adjusting the formulations to slightly basic pH's resulted in unexpected stabilization of activity for both enzymes. In summary, results at about pH 6–8 for the instant formulations demonstrated improved performance relative to other pH's, leading to preference herein such slightly basic pH's.

EXAMPLES 2 AND 3

In these Examples, a study was undertaken to determine which variable had a greater influence on the stability of the inventive enzyme-containing prewash compositions: introduction of a second enzyme stabilizer, or a change in hydrogen ion concentration (pH). For this purpose, Test Formula I was prepared according to Table IV below. Samples prepared as indicated in Examples 2 and 3 below were tested for loss of enzyme activity over time. The results of this study are summarized in Table V.

TABLE IV

Test Formula I

| Prewash Ingredient | Description | Quantity (wt. %) |
|---|---|---|
| First surfactant[1] | Nonionic surfactant, HLB > 11 | 3–6 |
| Second surfactant[2] | Nonionic surfactant, HLB ≦ 11 | 5–9 |
| First hydrolase enzyme solution[3] | Protein-hydrolyzing enzyme | 0.01–0.5 |
| Second hydrolase enzyme solution[4] | Non-protein hydrolyzing enzyme | 0.01–0.5 |
| First enzyme stabilizer[5] | | 0.01–0.05 |
| Adjuncts | Preservative, fragrance, dye | 0.001–1.0 |
| Water | Solvent | Balance |

[1]Alkoxylated alcohol or alkoxylated alkylphenol.
[2]Alkoxylated alcohol or alkoxylated alkylphenol.
[3]Alkaline protease used as received.
[4]Amylase used as received.
[5]$Ca^{++}$ ion.

Example 2

For the preparation of the sample used as Example 2, small quantities of preservative, fragrance and dye consistent with the descriptions and amounts indicated in Table I above were added to Test Formula I. A sufficient amount of base was added to the resulting composition to adjust the pH to 7.6.

Example 3

A second sample containing the same ingredients and relative amounts as in Example 2 above was prepared. In addition to including a sufficient amount of base to adjust the pH to 7.6, Example 3 also contained boric acid.

TABLE V

Stability Studies for Prewash Formulations With and Without a Second Enzyme Stabilizer at 37.8° C. (100° F.), pH 7.6

| Example No. | Description[1] | Percent Amylase Activity Remaining After: 2 weeks (wt. %) | 4 weeks (wt. %) | 12 weeks (wt. %) |
|---|---|---|---|---|
| 2 | Test Formula I | 90 | 80 | 20 |
| 3 | Test Formula I plus second enzyme stabilizer[2] | 90 | 100 | 90 |

[1]The Test Formula included nonylphenol ethoxylate (9–10 mole ethoxylate, HLB > 11), nonylphenol ethoxylate (5 mole ethoxylate, HLB < 11), calcium chloride, protease enzyme solution, amylase enzyme solution, preservative, fragrance, dye and balance water.
[2]Boric acid.

The samples studied above were stored at approximately 37.8° C. (100° F.) in order to simulate advanced aging for the times indicated. It may be seen from the results shown in Table V that the amounts of available amylase in the formulations which lacked a second enzyme stabilizer were relatively unchanged after 4 weeks' time, but that by 12 weeks at 37.8° C., a significant reduction in the amount of original amylase activity remained. The addition of a second enzyme stabilizer gave rise to amylase activities that showed virtually no change in amylase activity when monitored after 2 weeks', 4 weeks' or even 12 weeks' time.

EXAMPLES 4 TO 8

Several samples were prepared in order to determine what effects, if any, could be observed first, by using different materials as second enzyme stabilizers alone or in combination, and second, whether or not concentration was a factor. Accordingly, a number of samples were prepared according to Test Formula II indicated below in Table VI. There were no second enzyme stabilizers present in this formula The ingredients which were used complied with the descriptions and relative amounts as indicated in Table I above. All samples were stored at 37.8° C. (100° F.) to simulate advanced aging. The results of these studies are summarized below in Table VII.

TABLE VI

Test Formula II

| Prewash Ingredient | Description | Quantity (wt. %) |
|---|---|---|
| First surfactant[1] | Nonionic surfactant, HLB > 11 | 3–6 |
| Second surfactant[2] | Nonionic surfactant, HLB ≦ 11 | 5–9 |
| First hydrolase enzyme solution[3] | Protein-hydrolyzing enzyme | 0.01–0.5 |
| Second hydrolase enzyme solution[4] | Non-protein hydrolyzing enzyme | 0.01–0.5 |
| First enzyme stabilizer[5] | | 0.01–0.05 |
| Adjuncts | Preservative, fragrance, dye | 0.001–1.0 |
| Water | Solvent | Balance |

[1]Alkoxylated alcohol or alkoxylated alkylphenol.
[2]Alkoxylated alcohol or alkoxylated alkylphenol.
[3]Alkaline protease used as received.
[4]Amylase used as received.
[5]Calcium chloride.

Example 4

Example 4 was comprised of Test Formula II, as indicated above, consistent with the descriptions and amounts indicated in Table I. A sufficient amount of base was added to the resulting composition to adjust the pH to approximately 7.2–8.0.

Example 5

Example 5 contained Test Formula II indicated above, to which was added approximately 1.0 wt. % sodium thiosulfate.

Exanoke 6

Example 6 contained Test Formula II indicated above, to which was added approximately 0.6 wt. % boric acid.

Exanoke 7

Example 7 contained Test Formula II indicated above, to which was added approximately 0.6 wt. % boric acid and 1.0 wt. % sodium thiosulfate.

Example 8

Example 8 was similar to Example 7 above, except that the amount of sodium thiosulfate was reduced to about 0.1 wt. %.

TABLE VII

Stability Studies for Prewash Formulations With Different Second Enzyme Stabilizers at 37.8° C. (100° F.)

| Example No. | Test Formula II (TF)[1] Combination: | Percent Enzyme Activity Remaining After 12 Weeks: Protease (wt. %) | Amylase[2] (wt. %) |
|---|---|---|---|
| 4 | TF[3] | 25 | n.c. |
| 5 | TF + thiosulfate | 52 | n.c. |
| 6 | TF + boric acid | 57 | n.c. |
| 7 | TF + thiosulfate + boric acid | 66 | n.c. |
| 8 | TF + thiosulfate + boric acid | 63 | n.c. |

[1]Test Formula II included nonylphenol ethoxylate(9–10 mole ethoxylate, HLB > 11), nonylphenol ethoxylate (5 mole ethoxylate, HLB < 11), calcium chloride, protease enzyme, amylase enzyme, preservative, fragrance, dye, and balance water.
[2]There was essentially no change ("n.c.") in amylase activity from the initial amylase levels.
[3]No added ingredients.

The data in Table VII, taken in combination with the results shown in Tables II, III and V above, indicate that pH appears to have a greater influence on enzyme stability in the instant prewash formulations than does either composition or amount of the second enzyme stabilizer used. The results in Tables II and III indicate that at slightly acidic pH's, only low protease activity was detected after 4 weeks at 37.8° C., while virtually no amylase activity remained after the same length of time. As shown in Table VII, however, once the pH was raised from slightly acidic to mildly basic (pH about 7.2 to 8.0), the amount of active enzymes remaining even after 12 weeks at elevated temperatures demonstrated remarkable acceptability for the enzyme stability of the formulations. Specifically, the use of both boric acid and thiosulfate as shown in Examples 7 and 8 had virtually the same effect on enzyme stability as did the use of one second enzyme stabilizer alone (Examples 5 or 6). On the other hand, it is interesting to note that when the thiosulfate concentration was decreased by approximately one order of magnitude (i.e., from Example 7 to Example 8), a virtually indiscernible difference in enzyme stability resulted. This one advantageous feature of the present invention suggests that more actives can be used in the prewash formulations without concomitant jeopardy of enzyme efficacy.

EXAMPLES 9 AND 10

To confirm the beneficial enzyme stability characteristics for the instant prewash formulations, a series of samples were monitored over time at elevated temperatures to determine the effects of the mere addition of a non-protein hydrolyzing enzyme to a prewash formulation of the prior art. Thus, in Examples 9–12 below, a prewash composition similar to that described in copending and jointly owned application for patent, U.S. Ser. No. 08/474,353 was used as the starting point to test a series of different variables. The "Prior Art" formulation which was used is given in Table VIII below. All of the examples evaluated below were buffered to slightly acidic pH's according to the '353 application. The results of the studies are presented in Table IX below.

TABLE VIII

Prior Art Formulation

| Prewash Ingredient | Quantity (wt. %) |
|---|---|
| First surfactant[1] | 3–6 |
| Second surfactant[2] | 5–9 |
| First hydrolase enzyme solution[3] | 0.25 |
| First enzyme stabilizer[4] | 0.01–0.05 |
| Adjuncts[5] | 0.45 |
| Water | Balance |

[1]Nonylphenol ethoxylate, HLB > 11.
[2]Nonylphenol ethoxylate, HLB ≦ 11.
[3]Alkaline protease used as received.
[4]Calcium chloride.
[5]Mildewstat/bacteriostat, fragrance, and dye solution.

Example 9

Example 9 contained 0.025 wt % amylase in addition to the Prior Art formula indicated in Table VIII above.

Example 10

Example 10 was similar to Example 9, with the addition of 0.6 wt. % boric acid.

TABLE IX

Stability Studies for Prior Art Prewash Formulations With Added Amylase and Boric Acid at 37.8° C. (100° F.)

| Example No. | Prior Art (PA)[1]Formulation | Percent Enzyme Activity Remaining After: 2 Weeks (wt. %) | 4 Weeks (wt. %) | 8 Weeks (wt. %) | 12 Weeks (wt. %) |
|---|---|---|---|---|---|
| 9 | PA + amylase[2] | | | | |
| | Amylase activity: | 22 | 11 | n.a.[3] | n.a. |
| | Protease activity: | 76 | 56 | 25 | n.a. |
| 10 | PA + amylase[2] + boric acid[4] | | | | |
| | Amylase activity: | 22 | n.a. | n.a. | n.a. |
| | Protease activity: | 56 | 24 | 3 | n.a. |

[1]The prior art formula included nonylphenol ethoxylate (9–10 mole ethoxylate, HLB > 11), nonylphenol ethoxylate (5 mole ethoxylate, HLB < 11), calcium chloride, protease enzyme, preservative, fragrance, dye, balance water.
[2]0.025 wt. % amylase.
[3]Data not analyzed
[4]0.6 wt. % boric acid.

It will be understood that various other changes of the details or components and uses which have been described herein and illustrated in order to explain the nature of the invention will occur to and may be made by those skilled in the art upon a reading of this disclosure, and such changes are intended to be included within the principle and scope of this invention. The invention is further defined without limitation of scope or of equivalents by the claims which follow.

What is claimed:

1. A high water liquid enzyme prewash composition without hydrotropes, organic solvents, dispersants and surfactants, other than nonionic surfactants, comprising:

a) about 0.0001–10% of a first hydrolase enzyme stabilized with from about 1 to about 10,000 ppm of a first enzyme stabilizer, wherein the first enzyme stabilizer is a soluble alkaline earth salt;

b) about 0.1–9.99% of a more hydrophilic, first nonionic surfactant having an HLB of greater than about 11;

c) about 0.1–9.99% of a more hydrophobic, second nonionic surfactant having an HLB of less than or equal to about 11; and d) about 80–99% water;

wherein the difference in HLB between said first and said second nonionic surfactants is at least 2; said nonionic surfactants interact with said water to form an opalescent, structured liquid; said first and said second nonionic surfactants being selected from the group consisting of alkoxylated alcohols and alkoxylated alkylphenols; said structured liquid both suspending said hydrolase and protecting said hydrolase against deactivation with said water.

2. The liquid enzyme prewash composition of claim 1 wherein said hydrolase is a protease, an amylase, a cellulase, a lipase, a cutinase, or a mixture thereof.

3. The liquid enzyme prewash composition of claim 1 wherein said enzyme stabilizer interacts with said hydrolase enzyme to prevent any interaction whereby said hydrolase enzyme could attack, destabilize, denature or degrade a second enzyme, or wherein said enzyme stabilizer scavenges any deleterious entity that could otherwise destabilize, denature or degrade said hydrolase enzyme.

4. The liquid enzyme prewash composition of claim 1 further comprising a second hydrolase enzyme.

5. The liquid enzyme prewash composition of claim 4 wherein said second hydrolase enzyme is stabilized with from about 1 to about 10,000 ppm of a second enzyme stabilizer selected from the group consisting of boron compounds, reducing agents, short chain inorganic and organic acids, and mixtures thereof.

6. A high water liquid enzyme prewash composition without hydrotropes, organic solvents, dispersants and surfactants, other than nonionic surfactants, comprising:

a) about 0.0001–10% of a first hydrolase enzyme stabilized with from about 1 to about 10,000 ppm of a first enzyme stabilizer, wherein the first enzyme stabilizer is a soluble alkaline earth salt;

b) about 0.0001–10% of a second hydrolase enzyme;

c) about 1–10,000 ppm of a second enzyme stabilizer;

d) about 0.1–9.99% of a more hydrophilic, first nonionic surfactant having an HLB of greater than about 11;

e) about 0.1–9.99% of a more hydrophobic, second nonionic surfactant having an HLB of less than or equal to about 11; and f) about 80–99% water;

wherein said first and said second enzymes comprise different classes of enzymes; the difference in HLB between said first and said second nonionic surfactants is at least 2; said nonionic surfactants interact with said water to form an opalescent, structured liquid; said first and said second nonionic surfactants being selected from the group consisting of alkoxylated alcohols and alkoxylated alkylphenols; said structured liquid both suspending said enzymes and protecting said enzymes against deactivation with said water.

7. The liquid enzyme prewash composition of claim 6 wherein said first hydrolase enzyme is a protease and said second hydrolase enzyme is an amylase, a cellulase, a lipase, a cutinase, or a mixture thereof.

8. The liquid enzyme prewash composition of claim 6 wherein said second enzyme stabilizer is a boron compound, a reducing agent, a short chain inorganic or organic acid, or a mixture thereof.

9. The liquid enzyme prewash composition of claim 8 wherein said boron compound is boric acid, boric oxide or an alkali metal borate, and said reducing agent is an alkali metal salt of thiosulfate, sulfite and bisulfite or a mixture thereof.

10. The liquid enzyme prewash composition of claim 9 wherein said boron compound is boric acid and said alkali metal is sodium.

11. The liquid enzyme prewash composition of claim 7 wherein said protease is an alkaline protease, and said soluble alkaline earth salt interacts with said alkaline protease and said second hydrolase enzyme to maintain said protease and said second hydrolase enzyme in suspension in said structured liquid.

12. The liquid enzyme prewash composition of claim 6 wherein said soluble alkaline earth salt is selected from soluble magnesium and calcium salts, and said first and second nonionic surfactants are two different alkoxylated alkylphenols.

13. The liquid enzyme prewash composition of claim 12 wherein said first nonionic surfactant forms a first, continuous phase with said water and said second nonionic surfactant forms a dispersed, lamellar phase in said first phase, further wherein said first nonionic surfactant is selected from ethoxylated nonylphenols with an HLB of about 12 or greater and said second nonionic surfactant is selected from ethoxylated nonylphenols with an HLB of 10 or less.

14. The liquid enzyme prewash composition of claim 12 wherein said first nonionic surfactant is an ethoxylated nonylphenol with 9–10 moles of ethylene oxide per mole of alcohol and an HLB of 13.4, said second nonionic surfactant is an ethoxylated nonyiphenol with an HLB of 10, and the amounts of said first and second nonionic surfactants are from about 3–6% and about 5–9%, respectively.

15. The liquid enzyme prewash composition of claim 12 wherein the ratios of said first and second nonionic surfactants is about 5:1 to 1:5.

16. The liquid enzyme prewash composition of claim 6 further comprising a base to adjust to a pH of above about 6.8 to below about 9.

17. The liquid enzyme prewash composition of claim 16 wherein said base is either an inorganic base or an organic base.

18. The liquid enzyme prewash composition of claim 16 wherein said pH is maintained by means of a buffer.

19. The liquid enzyme prewash composition of claim 6 further comprising an aesthetic adjunct selected from the group consisting of fragrances, dyes, pigments, mildewstats and bacteriostats.

* * * * *